US010370161B2

(12) United States Patent
Yeager et al.

(10) Patent No.: US 10,370,161 B2
(45) Date of Patent: Aug. 6, 2019

(54) CHILD RESISTANT TIP CLOSURE ASSEMBLY WITH DIAPHRAGM

(71) Applicant: Amcor Rigid Plastics USA, LLC, Wilmington, DE (US)

(72) Inventors: Don F. Yeager, Millville, NJ (US); Todd Mastic, Saline, MI (US); Bradley S. Philip, Tecumseh, MI (US); David Downing, Manchester, MI (US); James Mierzwiak, Manchester, MI (US)

(73) Assignee: Amcor Rigid Plastics USA, LLC, Wilmington, DE (US)

( * ) Notice: Subject to any disclaimer, the term of this patent is extended or adjusted under 35 U.S.C. 154(b) by 879 days.

(21) Appl. No.: 14/442,692

(22) PCT Filed: Nov. 14, 2013

(86) PCT No.: PCT/US2013/070032
§ 371 (c)(1),
(2) Date: May 13, 2015

(87) PCT Pub. No.: WO2014/078495
PCT Pub. Date: May 22, 2014

(65) Prior Publication Data

US 2016/0288965 A1 Oct. 6, 2016

Related U.S. Application Data

(60) Provisional application No. 61/726,657, filed on Nov. 15, 2012.

(51) Int. Cl.
*B65D 50/04* (2006.01)
*B65D 41/04* (2006.01)

(52) U.S. Cl.
CPC ..... *B65D 50/041* (2013.01); *B65D 41/04* (2013.01); *B65D 41/0492* (2013.01); *B65D 2215/02* (2013.01)

(58) Field of Classification Search
CPC .... B65D 41/04; B65D 41/0492; B65D 50/02; B65D 50/041; B65D 50/046; B65D 50/068; B65D 2101/00; B65D 2215/02
(Continued)

(56) References Cited

U.S. PATENT DOCUMENTS 3,055,524 A * 9/1962 Glasbrenner ..... B65D 50/041 215/220
3,472,411 A * 10/1969 Turner ..... B65D 50/041 215/220
(Continued)

FOREIGN PATENT DOCUMENTS

EP 1002737 A1 * 5/2000 ..... B65D 41/3409
EP 1857373 A1 11/2007
(Continued)

OTHER PUBLICATIONS

International Search Report and Written Opinion for PCT/US2013/070032, dated Feb. 18, 2014; ISA/KR.
(Continued)

*Primary Examiner* — Chun Hoi Cheung
*Assistant Examiner* — Brijesh V. Patel
(74) *Attorney, Agent, or Firm* — Harness, Dickey & Pierce, P.L.C.

(57) ABSTRACT

A child resistant closure for use on a container that include an inner closure member having a threaded portion and an outer closure member coupled to the inner closure member for axial translation there between. A series of engagement features extend between the inner and outer closure to permit selective engagement of the outer closure to the inner closure to effect removal of the child resistant closure. The outer closure includes a diaphragm member disposed along the distal end surface of the outer closure. The diaphragm member is inwardly directed and contacts the inner closure
(Continued)

member thereby biasing the outer closure member into an operationally disengaged position.

14 Claims, 8 Drawing Sheets

(58) Field of Classification Search
USPC ..... 215/11.4, 216–221, 227, 251–253, 258, 215/260, 301, 344, 356, 364; 220/203.11, 220/203.17, 277, 281, 288, 367.1, 378; 222/562, 568; D9/434, 454
See application file for complete search history.

(56) References Cited

U.S. PATENT DOCUMENTS 3,622,027 A 11/1971 Maki
3,638,819 A * 2/1972 Roy ..... B65D 50/041 215/220
3,682,343 A 8/1972 Landen
3,698,585 A * 10/1972 Smith ..... B65D 50/041 215/220
3,722,727 A * 3/1973 Gach ..... B65D 50/041 215/220
3,776,407 A * 12/1973 Cistone ..... B65D 50/041 215/220
3,809,272 A * 5/1974 Maki ..... B65D 50/041 215/219
3,830,390 A * 8/1974 Gach ..... B65D 50/041 215/220
3,853,236 A * 12/1974 Ostrowsky ..... B65D 50/041 215/220
3,863,796 A 2/1975 Roy
3,878,961 A 4/1975 Curry et al.
3,912,101 A * 10/1975 Rayner ..... B65D 50/041 215/220
4,004,704 A * 1/1977 Hilaire ..... B65D 50/041 215/211
4,095,717 A * 6/1978 Michaelsen ..... B65D 50/041 215/220
4,385,705 A * 5/1983 Kusz ..... B65D 50/041 215/220
4,474,301 A * 10/1984 Davis ..... B65D 41/3452 215/220
4,520,938 A * 6/1985 Finke ..... B65D 50/041 215/220
4,555,036 A 11/1985 Bekkers et al.
4,705,181 A 11/1987 Burke et al.
4,834,251 A * 5/1989 Yu ..... B65D 41/06 215/222
4,854,459 A 8/1989 DeJonge
5,115,928 A * 5/1992 Drummond, Jr. .... B65D 50/068 215/216
5,611,443 A 3/1997 King
5,743,419 A 4/1998 King
5,918,752 A 7/1999 Meyer
6,875,201 B1 * 4/2005 Kawashima ..... A61F 9/0008 215/381
8,157,115 B2 4/2012 Rho
8,286,811 B1 * 10/2012 Adamczak ..... B65D 50/041 215/220
2002/0027120 A1 3/2002 Miceli et al.
2003/0034322 A1 2/2003 Doherty et al.
2005/0161425 A1 7/2005 Morini
2008/0164234 A1 7/2008 Rho
2008/0314000 A1 12/2008 Druitt
2009/0242561 A1 * 10/2009 Wellman ..... B65D 51/2828 220/277
2009/0250465 A1 10/2009 Martinez et al.
2013/0015157 A1 1/2013 Rho
2014/0014611 A1 * 1/2014 Buehler ..... B65D 50/02 215/217

FOREIGN PATENT DOCUMENTS

EP 1975079 A1 10/2008
GB 2182648 A 5/1987
JP 52-18632 A 5/1977
JP H11-501595 2/1999
JP 2000-226047 A 8/2000
JP 2008-030823 A 2/2008
JP 2010-076840 A 4/2010
KR 20060099794 A 9/2006

OTHER PUBLICATIONS

International Search Report and Written Opinion for PCT/U52013/070041, dated Feb. 27, 2014; ISA/KR.
Communication issued on May 29, 2017 in corresponding European Application No. 138552419 (5 pages).
Office Action dated Jun. 27, 2017 in corresponding Japanese Application No. 2015-542768 (4 pages).
U.S. Appl. No. 14/442,695, filed May 13, 2015, Bradley S. Philip et al.

* cited by examiner

CHILD RESISTANT TIP CLOSURE ASSEMBLY WITH DIAPHRAGM

CROSS-REFERENCE TO RELATED APPLICATIONS

This application claims the benefit of U.S. Provisional Application No. 61/726,657, filed on Nov. 15, 2012. The entire disclosure of the above application is incorporated herein by reference.

FIELD

The present disclosure relates to child resistant closures and, more particularly, relates to child resistant tip closure assemblies having conical shaped diaphragms.

BACKGROUND

This section provides background information related to the present disclosure which is not necessarily prior art.

Child resistant closures have been used in a wide variety of applications for many years. Traditionally, these child resistant closures, often referred to as CRCs, are used to provide a disengagement feature in the lid of a container or package to prevent access of the contents of the container by a child. To this end, the lid of the container often includes a mechanical engagement system that is normally disengaged to permit the free rotation of an outer member of the lid relative to an inner member of the lid. The outer member of the lid is configured to be grasped by a user and the inner member of the lid is configured to, typically, threadedly engage the opening or finish of the container. The outer member of the lid can, in some traditional designs, include a feature that must be manipulated by an adult user to engage outer and inner closure. This adult-manipulated feature may include various prong devices, spring compression, lifting mechanism or similar device.

Unfortunately, current CRC designs tend to employ adult-manipulated features that are particularly well suited for large containers, such as medicine bottles, cleaning detergent bottles, and the like. However, more recently, there has been a regulatory move to requiring the use of CRCs on containers that are substantially smaller than current containers employing CRCs.

In particular, the Consumer Product Safety Commission (CPSC) has notified the ophthalmic industry of the Commission's plans to require certain product packages that contain at least 0.08 mg of Imidazolines, such as ophthalmic products, will be required to employ child resistant closures on its containers and packaging. Unfortunately, traditional child resistant closures have not been employed in smaller containers, such as, but not limited to, those containers having finish openings less than or equal to about 20 mm.

Furthermore, it appears that traditional child resistant closures, which are used on larger containers, cannot be easily scaled down to work on smaller containers. That is, because many of these traditional child resistant closures employ mechanical or living hinges and/or other mechanical engagement systems, these traditional child resistant closures cannot simply be reduced in size because of the changing in operation of the hinges or engagement systems. What is needed, in order to comply with the potential for new regulations and to provide the market with a viable and reliable child resistant closure, is a child resistant closure that can properly, reliably, and safely operate on or in closures adapted for use with small containers or packages, such as, but not limited to, containers having finish openings less than or equal to about 20 mm. It should be understood that although the aforementioned goal is an object of the present teachings, it should not be regarded as limiting the scope of the present teachings or the use of the closures of the present application. It should be understood that child resistant closures used on small containers can often be up-scaled for use on larger containers; however, child resistant closures used on large containers cannot often be down-scaled for use on smaller containers. However, the teachings of the present application provide a child resistant closure that can be used on containers having finish openings less than or equal to about 20 mm. It should be understood that the present teachings can be used on finish openings greater than 20 mm. Moreover, the present teachings are particularly well-suited for use on ophthalmic or other containers having 18 mm, 15 mm, and 13 mm finishes.

SUMMARY

This section provides a general summary of the disclosure, and is not a comprehensive disclosure of its full scope or all of its features.

According to the principles of the present teachings, a child resistant closure is provided for use on a container that include an inner closure member having a threaded portion and an outer closure member coupled to the inner closure member for axial translation there between. A series of engagement features extend between the inner and outer closure to permit selective engagement of the outer closure to the inner closure to effect removal of the child resistant closure. The outer closure includes a diaphragm member disposed along the distal end surface of the outer closure. The diaphragm member is inwardly directed and contacts the inner closure member thereby biasing the outer closure member into an operationally disengaged position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
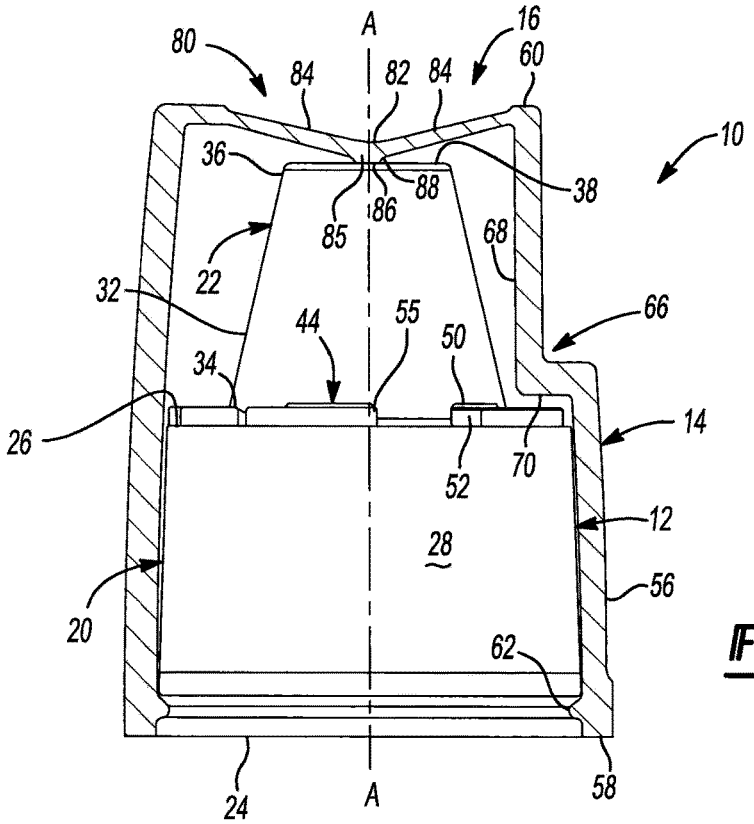
FIG. 1 is a cross-sectional view illustrating a child resistant tip closure assembly according to the principles of the present teachings.
Figure 2:
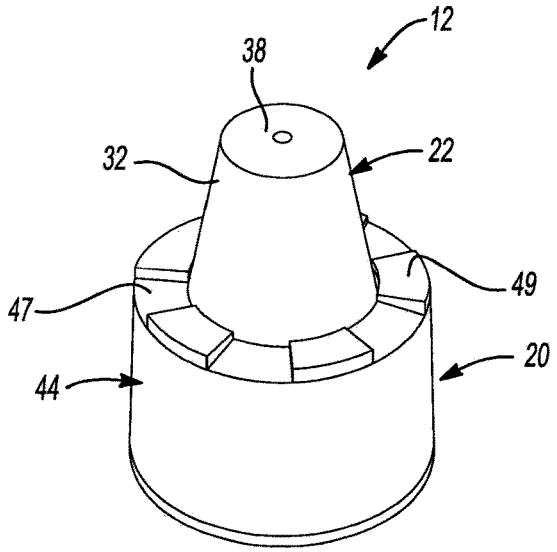
FIG. 2 is a perspective view of an inner closure member according to the principles of the present teachings.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

According to the principles of the present teachings, as described in the following description and illustrated in the attached figures, a novel child resistant closure (CRC) assembly 10 is provided that overcome the limitations of the prior art and provides a safe and reliable tip closure that is capable of being using on any number of packages or containers. In particular, the CRC assembly 10 is well-suited for containers or packages that define a small-sized finish, such as less than or equal to about 20 mm. In some embodiments, the present teachings are particular well-suited for use on containers having finishes that are less than or about 18 mm, or specifically 15 mm and 13 mm. It should be understood, however, the present teachings can be easily up-sized to be used on containers having larger finish dimensions, such as greater than 20 mm. Therefore, the teachings of the present application should not be regarded as being limited to any particular size, unless specifically and explicitly claimed in the Claims section herein.

Figure 15:
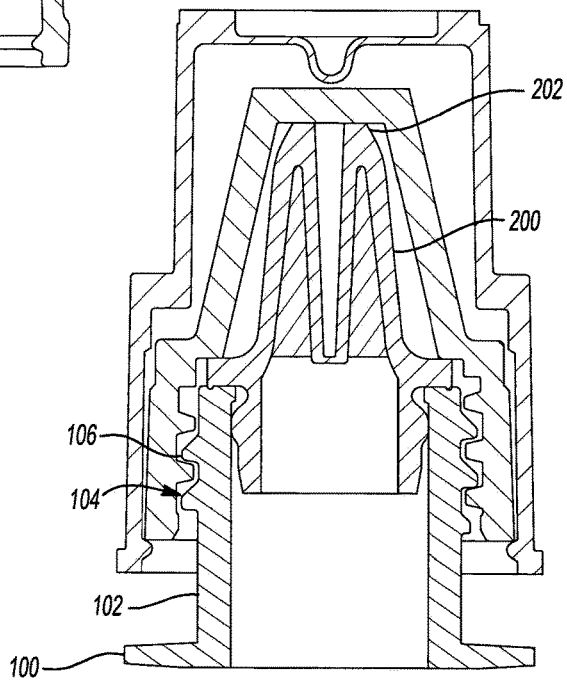
FIG. 15 is a cross-sectional view of a child resistant tip closure assembly according to some embodiments of the present teachings.
Figure 16:
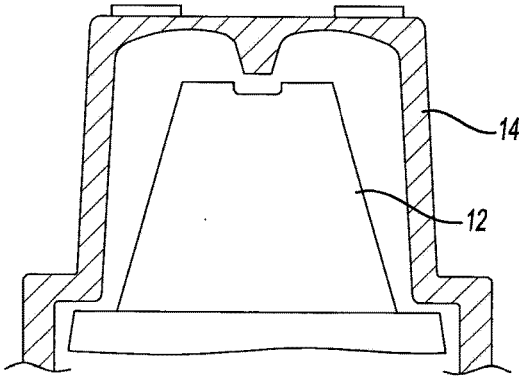
FIG. 16 is a cross-sectional view of a child resistant tip closure assembly according to some embodiments of the present teachings.
Figure 17:
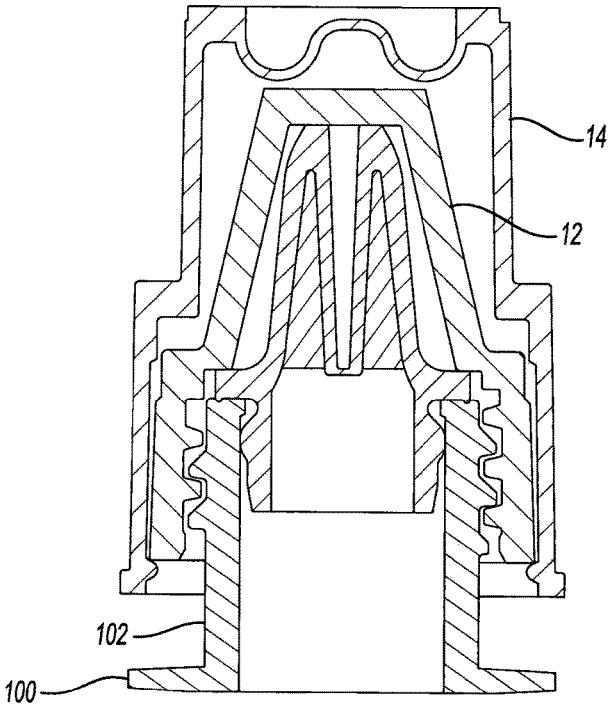
FIG. 17 is a cross-sectional view of a child resistant tip closure assembly according to some embodiments of the present teachings.
Figure 18:
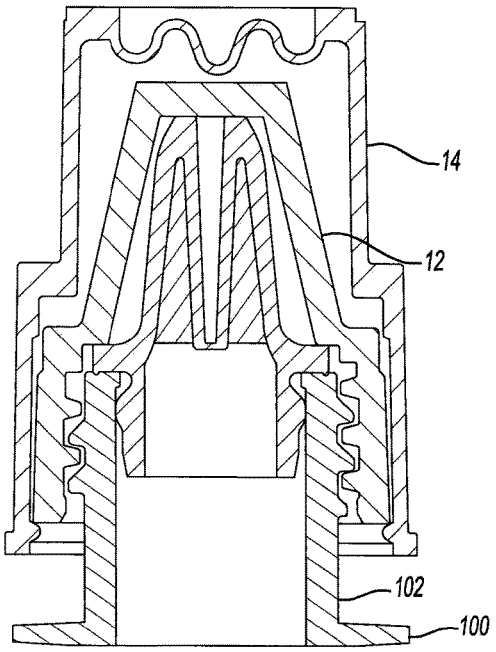
FIG. 18 is a cross-sectional view of a child resistant tip closure assembly according to some embodiments of the present teachings.
Figure 19:
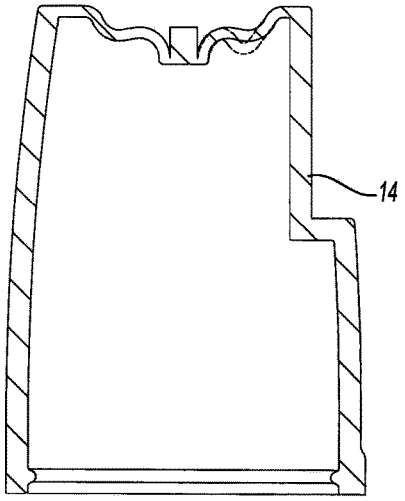
FIG. 19 is a cross-sectional view of a child resistant tip closure assembly according to some embodiments of the present teachings.
Figure 20:
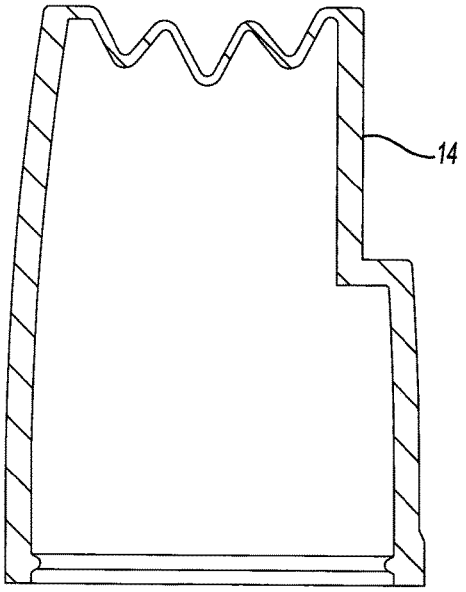
FIG. 20 is a cross-sectional view of a child resistant tip closure assembly according to some embodiments of the present teachings.
Figure 21:
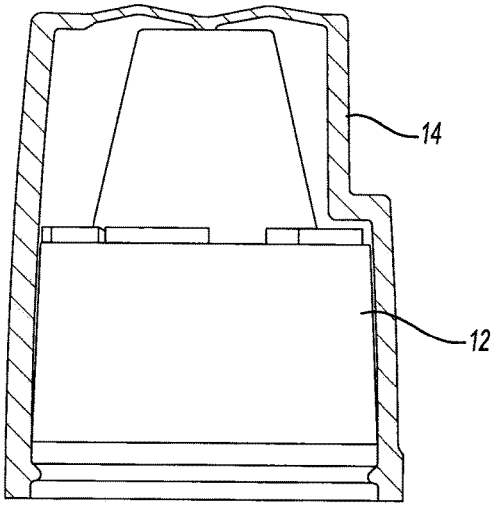
FIG. 21 is a cross-sectional view of a child resistant tip closure assembly according to some embodiments of the present teachings.

Briefly, it should be understood that the CRC assembly 10 of the present teachings is adapted to be threadedly engaged with the finish 102 of a container 100 (see FIGS. 15, 17, and 18). Such containers typically define a body that includes an upper portion having a cylindrical sidewall forming a finish 102. Integrally formed with the finish and extending downward therefrom is a shoulder portion. The shoulder portion merges into and provides a transition between the finish 102 and a sidewall portion. The sidewall portion extends downward from the shoulder portion to a base portion having a base, thereby enclosing a volume for retaining a product. The finish 102 of the container 100 may include a threaded region 104 having threads 106. The threaded region 104 provides a means for attachment of a similarly threaded portion of CRC assembly 10, which will be described herein. Accordingly, CRC assembly 10 engages the finish 102 to preferably provide a hermetical seal of the container 100.

In some embodiments, as illustrated in FIGS. 15, 17, and 18, container 100 can comprise a dispensing tip 200 for dispensing the contained product in an advantageous way or for dosing a predetermined amount of the product. For instance, container 100 can be used for dispensing an ophthalmic medication and, thus, may employ a dispensing tip (e.g. eye dropper). Conventional dispensing tips are often sized to be press-fit within a portion of finish 102 of container 100 and comprise an elongated tip having a distal end 202 through which product is dispensed.

Although container 100 is illustrated and described as an ophthalmic container dispensing ophthalmic product, it should be understood that container 100 can be any container having any product to which employing a child resistant closure is advantageous. Therefore, the aesthetic styling of container and CRC assembly 10 can have different shapes, materials, and the like, without departing from the principles of the present teachings.

With general reference to the FIG. 1, CRC assembly 10 of the present teachings is a child resistant tip closure that is generally regarded as being of the "push down and turn" class of child resistant closures. This class of child resistant closures employs two mechanisms that must be combined for removal of the closure; namely, a downward force to operationally engage teeth between the outer closure and inner closure and rotation to unscrew the closure from the container. The combination of two mechanisms increases the likelihood that a child cannot break into the container due to the complexity of the cognitive and major motor skills required. A spring mechanism is typically employed to separate the inner closure from the outer closure, however conventional designs have failed to provide a system that can be used on small finish containers.

With particular reference to FIG. 1, CRC assembly 10 is illustrated having an inner closure 12 and an outer closure 14 disposed upon and circumferentially surrounding and encapsulating inner closure 12. In this way, mechanical manipulation of inner closure 12 is limited to only being achieved via outer closure 14. Inner closure 12 and outer closure 14 are sized and configured to permit relative axial translation there between. Specifically, outer closure 14 is sized and configured to permit axial translation from an operationally disengaged position, which permits free rotational movement of outer closure 14 relative to inner closure 12, and an operationally engaged position, which selectively joins outer closure 14 and inner closure 12 for simultaneous joined rotation there between. It should be recognized that in the disengaged position, outer closure 14 will spin freely relative to inner closure 12 thereby preventing threaded disengagement of inner closure 12 from finish 102 of container 100. Conversely, in the engaged position, outer closure 14 is keyed or otherwise joined to inner closure 12 for rotation therewith to permit rotational force of outer closure 14 to rotate inner closure 12, thereby threadedly disengaging inner closure 112 from finish 102. Outer closure 14 is normally biased into the disengaged position by a spring system 16, as will be discussed in detail herein. During actuation, outer closure 14 is depressed a predetermined stroke distance by overcoming the biasing force of spring system 16 such that complementary features of inner closure 12 and outer closure 14 are joined to permit the aforementioned keyed or joined configuration for rotation.

With particular reference to FIGS. 1-7, inner closure 12 generally comprises a body portion 20 and a cap portion 22. In some embodiments, body portion 20 comprises a generally cylindrical body having a proximal end 24, a distal end 26, and an outer sidewall 28 extending there between. In some embodiments, proximal end 24 is generally flat and, as will be discussed herein, abuts or otherwise engages a portion of outer closure 14. Sidewall 28 is generally closely spaced relative to an inner sidewall of outer closure 14, thereby it is desirable, in some embodiments, that sidewall 28 of inner closure 12 is without obstructions to permit the free rotation of outer closure 14 relative to inner closure 12. In other embodiments, sidewall 28 of inner closure 12 may have obstructions to permit securing closure on to container finish. In some embodiments, inner closure 12 is injection mold and formed of a thermoplastic material.

Inner closure 12 can further comprise a threaded portion 30 (FIG. 6) extending along an interior side of sidewall 28. Threaded portion 30 is sized and configured to threadedly engage the corresponding threads 106 of threaded portion 104 of container 100 in a known manner.

In some embodiments, cap portion 22 of inner closure 12 can comprise a generally conical shape having a generally converging sidewall 32 extending from a proximal end 34, which is adjoined to distal end 26 of body portion 20 (and, in some embodiments, integrally formed therewith), to a distal end 36. Distal end 36, in some embodiments, forms a generally-flat, outer, truncated surface 38. In some embodiments, cap portion 22 can comprise a generally uniform interior surface offset from sidewall 32 and truncated surface 38. More particularly, in some embodiments, cap portion 22 can comprise a converging interior sidewall 40 terminating at an interior end surface 42. In some embodiments, interior end surface 42 is sized to physically contact or otherwise engage distal end 202 of dispensing tip 200 to provide a seal there between for containing product.

It should be understood that inner closure 12 can be varied in any one of a number of ways. By way of non-limiting example, it should be understood that cap portion 22 can be sized or shaped to more appropriately complement a varied dispensing tip shape. That is, if a different dispensing shape is desired, a revised interior shape of cap portion 22 that closely conforms to the dispensing tip may also be desired. To minimize material issues as a result of molding the revised cap portion, it might thus be desirable to translate any shape modifications of the interior of cap portion 22 to the outer surface thereof. Thus, the overall shape of cap portion 22, and/or inner closure 12, may vary. But, such variations should not be regarded as departing from the principles of the present teachings.

Figure 3:
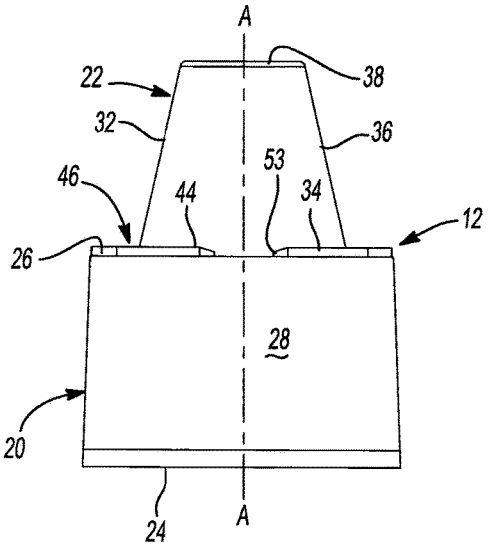
FIG. 3 is a side view of the inner closure member according to the principles of the present teachings.
Figure 4:
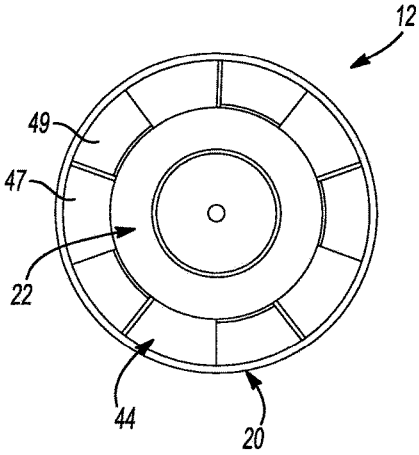
FIG. 4 is a top view of the inner closure member according to the principles of the present teachings.
Figure 5:
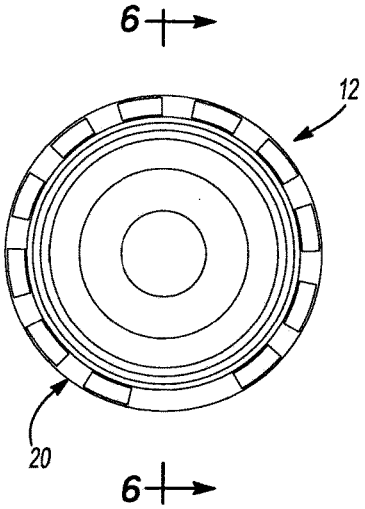
FIG. 5 is a bottom view of the inner closure member according to the principles of the present teachings.
Figure 6:
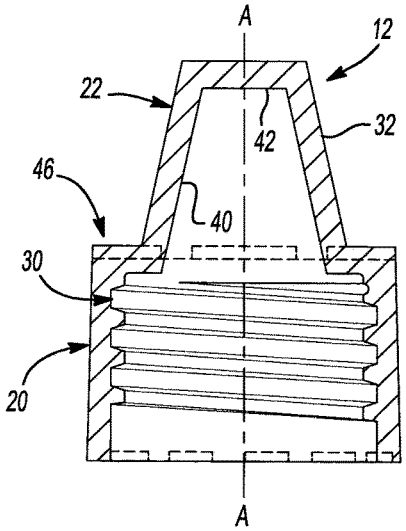
FIG. 6 is a cross-sectional view of the inner closure member taken along line 6-6 of FIG. 5 according to the principles of the present teachings.
Figure 7:
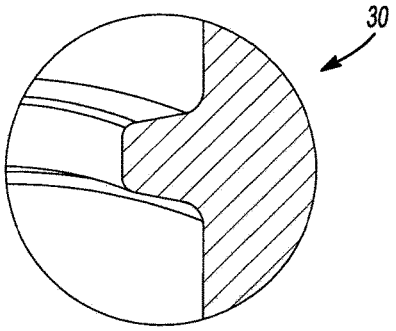
FIG. 7 is a partial cross-sectional side view of the inner closure member according to the principles of the present teachings.
Figure 8:
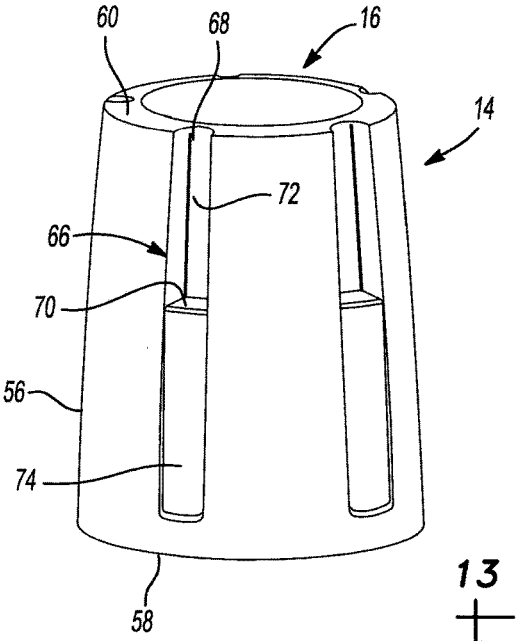
FIG. 8 is a perspective view of an outer closure member having a conical-shaped diaphragm according to the principles of the present teachings.
Figure 9:
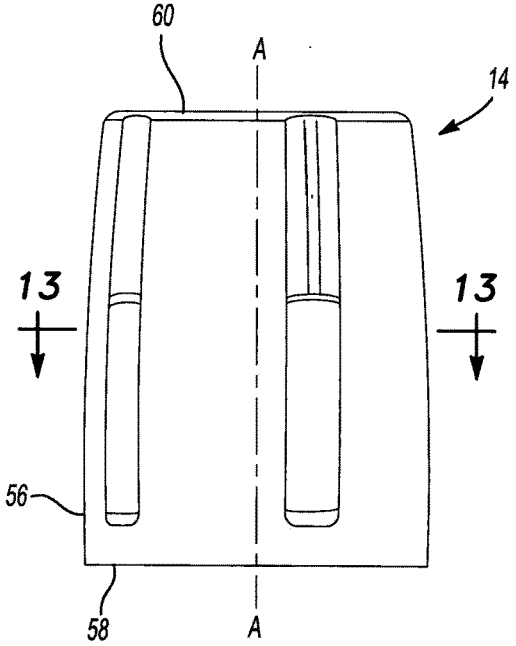
FIG. 9 is a side view of the outer closure member according to the principles of the present teachings.
Figure 10:
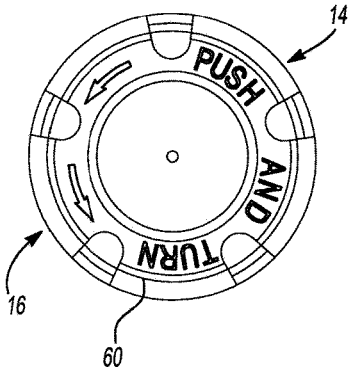
FIG. 10 is a top view of the outer closure member according to the principles of the present teachings.
Figure 11:
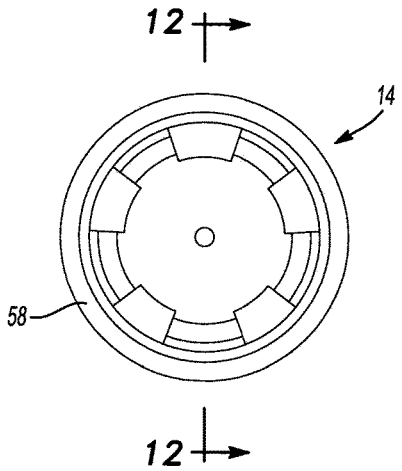
FIG. 11 is a bottom view of the outer closure member according to the principles of the present teachings.
Figure 12:
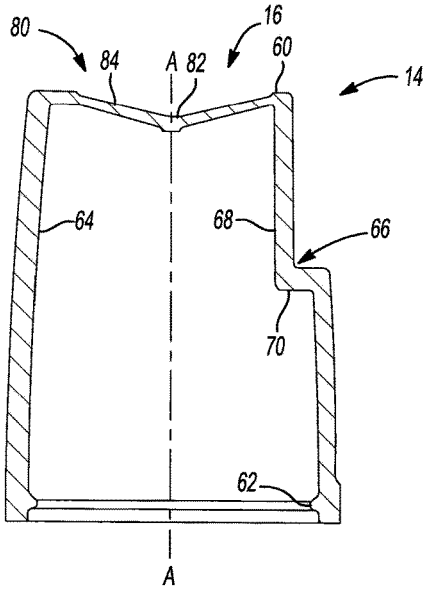
FIG. 12 is a cross-sectional view of the outer closure member taken along line 12-12 of FIG. 11 according to the principles of the present teachings.
Figure 13:
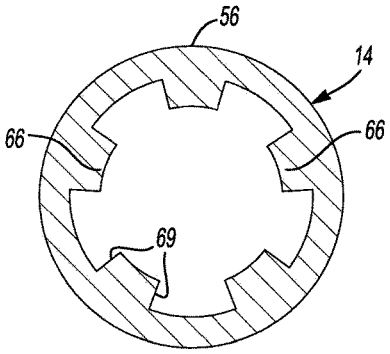
FIG. 13 is a cross-sectional top view of the outer closure member taken along line 13-13 of FIG. 9 according to the principles of the present teachings.
Figure 14:
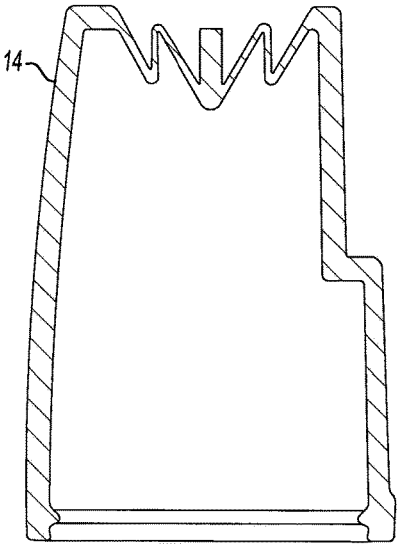
FIG. 14 is a cross-sectional view of a child resistant tip closure assembly according to some embodiments of the present teachings.

With continued reference to FIGS. 1-7, inner closure 12 can further comprise a series of keys or engagement features 44 radially disposed about a shoulder region 46 thereof. Shoulder region 46, in some embodiments, is formed along a junction of distal end 26 of body portion 20 and proximal end 34 of cap portion 22. Shoulder region 46 can define a surface that is generally orthogonal to a longitudinal axis A-A (FIGS. 3-4). In some embodiments, engagement features 44 comprise radially-disposed, alternating, raised features 49 and lowered features 47 extending about axis A-A along shoulder region 46. It should be understood that alternative shapes of engagement features 44 are anticipated, including rectangular, triangular, serrated, and the like. As will be described, engagement features 44 are sized and shaped to complementarily engage corresponding features formed on outer closure 14 to permit the selective joining of outer closure 14 and inner closure 12 for rotation therewith. In some embodiments, engagement features 44 comprise a plurality of, such as five, raised drivers each having a generally flat top surface 50 (orthogonal to axis A-A) and a generally flat drive surface 52 (parallel to axis A-A) interspersed with lowered or recessed sections (see FIG. 1). In some embodiments, drivers can have a chamfered edge 53 (see FIG. 3) and/or radius edge 55 (see FIG. 1) (or other edge feature) to control and/or modify the associated opening and closing force.

Turning now to FIGS. 8-13, outer closure 14 generally comprises a sidewall 56 having an open proximal end 58 and terminating at an enclosed distal end surface 60. In some embodiments, proximal end 58 is generally flat and abuts or otherwise engages proximal end 24 of inner closure 12. To this end, outer closure 14 can comprise an enlarged retaining ring or flange 62 (FIGS. 1 and 12) circumferentially extending about an inner surface 64 of sidewall 56 adjacent proximal end 58. Retaining ring 62 can be integrally formed with outer closure 14 such that, when outer closure 14 is installed on inner closure 12, retaining ring 62 under hooks proximal end 24 of inner closure 12. In this way, retaining ring 62 captures proximal end 24 of inner closure 12 and retains outer closure 14 in an engaged positioned with inner closure 12, yet permits free relative rotation there between when outer closure 14 is in the operationally disengaged position relative to inner closure 12. In some embodiments, retaining ring 62 can define a generally inwardly-directed sloped surface having generally symmetrical ramped surfaces on opposing, longitudinal side. However, it should be understood that retaining ring 62 can comprise alternative cross-sectional shapes, such as a hook shape or other shape that permits easy assembly of outer closure 14 to inner closure 12, but generally prevents removal of outer closure 14 from inner closure 12, yet still provides free rotational movement there between.

As described herein, sidewall 56 of outer closure 14, and particularly inner surface 64 of sidewall 56, is generally shaped to closely conform to sidewall 28 of inner closure 12, yet permit free rotational movement there between. Accordingly, in some embodiments, inner surface 64 of sidewall 56, at least those portions adjacent sidewall 28 of inner closure 12, are generally free of obstructions. In other embodiments, sidewall 28 of inner closure 12 may have obstructions to permit securing closure on to container finish.

In some embodiments, outer closure 14 can comprise a generally cylindrical shape extending from proximal end 58 to distal end surface 60. In some embodiments, outer closure 14, specifically sidewall 56, can comprise a generally uniform interior surface 64 offset from sidewall 56. In some embodiments, sidewall 56 and/or interior surface 64 can define a draft angle to permit improved manufacturing.

It should be understood that outer closure 14 can be varied in any one of a number of ways. By way of non-limiting example, it should be understood that outer closure 14 can be sized or shaped to more appropriately complement a varied dispensing tip shape or improve user manipulation. Such variations should not be regarded as departing from the principles of the present teachings.

With continued reference to FIGS. 8-13, outer closure 14 can further comprise a series of keys or engagement features 66 radially disposed and inwardly extending toward axis A-A along sidewall 56. More particularly, engagement features 66, in some embodiments, extend inwardly a sufficient distance from sidewall 56 and extend downwardly a sufficient distance from distal end surface 60 to selectively engage engagement features 44 of inner closure when in the operationally engaged position. In this way, engagement features 66 comprise radially-disposed, alternating, inwardly-directed raised features 68 terminating at a head 70 extending about axis A-A. In some embodiments, engagement features 66 are sized and shaped to complementarily engage engagement features 44 of lower closure 12. In this way, head 70 of engagement feature 66 of outer closure 14 engages and is otherwise captured at lowered feature 47 of inner closure 12 between opposing raised features 49. Side surfaces 69, of engagement features 66 (see FIG. 13), contacts drive surfaces 52 of inner closure 12. In this way, engagement feature 66 of outer closure 14 is keyed or otherwise joined with engagement feature 44 of inner closure 12 such that rotational or torsional force applied to outer closure 14 is translated to inner closure 12 for actuation of inner closure 12. Similarly, head 70 of outer closure 14 contacts shoulder region 46 of inner closure 12, to prevent further compressing translation of outer closure 14 relative to inner closure 12 in an axial direction. As will be described, this axial-translation, physical-stop feature is useful in minimizing excessive actuation of spring system 16.

In some embodiments, as illustrated in FIGS. 8-13, engagement feature 66 of outer closure 14 can be configured such that the inwardly-directed features 68 defines a consistent material wall thickness relative to the remaining portions of outer closure 14, thereby resulting in consistent and uniform material qualities and molding results. Moreover, this configuration further results in major recesses 72 being formed in sidewall 56 and viewable from an exterior portion of the outer closure 14. These major recesses 72 are radially disposed about outer closure 14 in alignment with engagement features 66. Major recesses 72 provide improved gripping surface for a user. In some embodiments, major recesses 72 can include extended minor recesses 74. Minor recesses 74 can extend from major recesses 72 toward proximal end 58 for enhanced gripping surface.

With particular reference to FIGS. 1, 8, 10, and 12, spring system 16 will now be discussed in detail. In some embodiments, spring system 16 provides a biasing member operably coupled between inner closure 12 and outer closure 14 to bias outer closure 14 into the aforementioned operational disengagement position. In some embodiments, spring system 16 can comprise a conical-shaped diaphragm member 80 disposed in distal end surface 60 of outer closure 14. Conical-shaped diaphragm member 80 is inwardly directed such that contact and deflection of conical-shaped diaphragm member 80 causes conical-shaped diaphragm member 80 to move outwardly along axis A-A (or upwardly) against the inward cone shape of the member providing biasing resistance.

More particularly, in some embodiments, conical-shaped diaphragm member 80 comprises a generally concave shape that, when viewed in cross-section, extends from a central region 82 radially outwardly along a radial flexural member 84. Flexural member 84 terminates along distal end surface 60. Specifically, in some embodiments, central region 82 comprises a gate head 85, or other enlarged portion, having a generally flat contact surface 86. However, it should be appreciated that contact surface 86 can be rounded, triangular, pointed, or otherwise shaped to provide a tailored contact point or surface. Contact surface 86 is the lowermost portion of spring system 16 and represents an offset distance from flexural member 84 to prevent or at least minimize contact between flexural member 84 and inner closure 12. The contact surface 86 of gate head 85 is, in some embodiments, a predetermined contact point between spring system 16 and inner closure 12 to provide a consistent and reliable deflection and spring response profile. It has been found that without such contact point, spring response is less than advantageous. However, it should be understood that contact surface 86 can be eliminated in some embodiments. Conversely, in some embodiments, gate head 85 can be used as the preferred location of an injection molding gate to facilitate convenient molding of outer closure 14. In some embodiments, conical-shaped diaphragm member 80 can comprise a radius portion 88 disposed between gate head 85 and flexural member 84 to reduce stress concentration and plastic deformation (i.e. engineering plastic deformation (e.g. irreversible deformation)) in the area.

In some embodiments, flexural member 84 is configured to provide a variable or otherwise tailored flexural response when outer closure 14 is depressed against inner closure 12. In this way, downward application of force on outer closure 14 causes contact pressure between truncated surface 38 of inner closure and contact surface 86 of outer closure 14 thereby resulting in upward elastic deflection of flexural member 84.

To achieve this tailored flexural response, flexural member 84 is generally thicker in the central area (that is, closest to the axial center) and is generally thinner in the outer radial area (that is, outboard from the axial center). Specifically, in some embodiments, there is a gradual and consistent thinning of the wall thickness of flexural member 84 from the central area to the outer radial area, such that the greatest wall thickness of flexural member 84 occurs at the axial center and the thinnest wall thickness of flexural member 84 occurs at the outer radial area. However, other response profiles and associated wall thickness specifications are envisioned. In some embodiments, the outer radial area extends to distal end surface 60. The thickest section (i.e. central area) of flexural member provides high resistance to bending, increases the spring force, and minimizes strain and plastic deformation on the center of the diaphragm member 80. Conversely, the thinnest section (i.e. outer radial area) provides for flexure of diaphragm member 80, while minimizing stress and plastic deformation in this area. This enables repeated use of the closure without decay of the spring mechanism.

The depth of spring system 16, and specifically flexural member 84, is provided such that necessary deflection of outer closure 14 relative to inner closure 12 does not result in plastic deformation of spring system 16. In other words, the depth of spring system 16 is determined such that the necessary stroke of outer closure 14 relative to inner closure 12 to achieve engagement of engagement features 66 of outer closure 14 with engagement features 44 of inner closure 12 does not result in plastic deformation of flexural member 84. Moreover, the depth of spring system 16 is further chosen such that the required stroke distance does not result in flexural member 84 becoming inverted or "popping out." The angle of conical-shaped diaphragm member 80 from the horizontal top surface of the closure is proportional to the diameter of the cap for proper function.

A physical axial translation limitation prevents conical-shaped diaphragm member 80 from over travel resulting in plastic deformation. This physical axial translation limitation can include the aforementioned physical stop between head 70 of outer closure and shoulder region 46.

In some embodiments, inner closure 12 and outer closure 14 can be made of dissimilar materials to minimize friction between the two members, once assembled. In some embodiments, inner closure 12 can be made of polypropylene and outer closure 14 can be made of high density polyethylene or polypropylene copolymer.

With reference to FIGS. 14-21, it should be appreciated that alternative designs exist for spring system 16. For example, in some embodiments, spring system 16 can comprise a diaphragm member having a series of molded, upturned flexible features, each providing a flexural response to application of translation force to outer closure relative to inner closure. That is, in some embodiments, the diaphragm member can be conical, parabolic, elliptical, generally "W" shaped, generally "S" shaped, and the like.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A child resistant closure for use on a container, said container having a threaded finish, said child resistant closure comprising:

an inner closure member having:

a threaded portion, said threaded portion being configured to threadedly engage the threaded finish;

a base portion having said threaded portion;

a cap portion extending from said base portion, said cap portion terminating in a distal cap end;

a shoulder between the base portion and the cap portion, the shoulder includes a surface that surrounds the cap portion and is orthogonal to a longitudinal axis of the child resistant closure about which the child resistant closure is rotatable and compressible;

a plurality of first engagement features extending from said shoulder of said inner closure member;

an outer closure member having a sidewall and a distal end surface, said outer closure member being operably coupled to said inner closure member to permit limited axial translation along the longitudinal axis between said outer closure member and said inner closure member;

a plurality of second engagement features extending from said outer closure member, said outer closure member being positionable in an operationally engaged position wherein said plurality of second engagement features engage said plurality of first engagement features to fix said outer closure member into rotation with said inner closure member, said outer closure member being positionable in an operationally disengaged position wherein said plurality of second engagement features are disengaged from said plurality of first engagement features to permit free rotational movement around said axis of said outer closure relative to said inner closure, movement between said operationally engaged position and said operationally disengaged position being along said longitudinal axis of the child resistant closure;

a diaphragm member being disposed along said distal end surface of said outer closure, said diaphragm member being inwardly directed and contacting said distal cap end of said inner closure member thereby biasing said outer closure member into said operationally disengaged position;

wherein the container includes a dispensing tip extending from the threaded finish, the base portion and the cap portion of the inner closure member are sized and shaped to sit over the dispensing tip when the threaded portion of the inner closure member is threadably engaged with the threaded finish;

wherein said diaphragm member includes a central portion and a flexural member extending radially from said central portion to said distal end surface; and wherein said central portion comprises a contact surface, the longitudinal axis of the child resistant closure extends through a center of the contact surface, said contact surface contacting said inner closure member in said operationally engaged position at an axial center of said inner closure member through which the longitudinal axis of the child resistant closure extends, said flexural member being spaced apart from said inner closure member in said operationally engaged position.

2. The child resistant closure according to claim 1 wherein a wall thickness of said flexural member is a first thickness near said central portion and a second thickness adjacent said distal end surface, said second thickness being less than said first thickness.

3. The child resistant closure according to claim 1 wherein a wall thickness of said flexural member is a first thickness near said central portion and a second thickness adjacent said distal end surface, said first thickness and said second thickness are the same.

4. The child resistant closure according to claim 1 wherein a wall thickness of said flexural member is a first thickness near said central portion and a second thickness adjacent said distal end surface, said second thickness is greater than said first thickness.

5. The child resistant closure according to claim 1 wherein a wall thickness of said flexural member is a first thickness near said central portion and a second thickness adjacent said distal end surface, said wall thickness of said flexural member extends uniformly from said first thickness to said second thickness.

6. The child resistant closure according to claim 1 wherein a wall thickness of said flexural member is a first thickness near said central portion and a second thickness adjacent said distal end surface, said wall thickness of said flexural member extends non-uniformly from said first thickness to said second thickness.

7. The child resistant closure according to claim 1 wherein said diaphragm member is shaped to minimize irreversible deformation in said operationally engaged position.

8. The child resistant closure according to claim 1 wherein a stroke distance between said operationally disengaged position and said operationally engaged position is less than a distance that would result in irreversible deformation of said diaphragm member.

9. The child resistant closure according to claim 1 wherein engagement of said plurality of first engagement features with said plurality of second engagement features results in a physical stop preventing further axial translation of said outer closure member relative to said inner closure member.

10. The child resistant closure according to claim 1, further comprising:

a retaining ring extending along said outer closure member, said retaining ring engaging a proximal end of said inner closure member retaining said outer closure member and said inner closure member in said operably coupled position.

11. The child resistant closure according to claim 1 wherein said plurality of second engagement features comprises:

a recess formed in said outer closure member, said recess terminating in a head.

12. The child resistant closure according to claim 1 wherein at least one of said plurality of first engagement features and said plurality of second engagement features includes an edge feature disposed thereon capable of modifying the force necessary to maintain said outer closure member in said operationally engaged position.

13. The child resistant closure according to claim 12 wherein said edge feature comprises a chamfered edge.

14. The child resistant closure according to claim 12 wherein said edge feature comprises a radiused edge.

* * * * *